US005727970A

United States Patent [19]

Koguchi et al.

[11] Patent Number: 5,727,970

[45] Date of Patent: Mar. 17, 1998

[54] INTERFACE CONNECTOR

[75] Inventors: Yasuyuki Koguchi; Yukio Saito, both of Tokyo, Japan

[73] Assignee: DDK Ltd., Japan

[21] Appl. No.: 704,883

[22] Filed: Aug. 30, 1996

[30] Foreign Application Priority Data

Nov. 1, 1995 [JP] Japan ..... 7-309820

[51] Int. Cl.[6] ..... H01R 13/648

[52] U.S. Cl. ..... 439/607; 439/108; 439/358

[58] Field of Search ..... 439/108, 358, 439/567, 571, 368, 607

[56] References Cited

U.S. PATENT DOCUMENTS

| | | | |
|---|---|---|---|
| 4,420,207 | 12/1983 | Nishikawa | 439/368 |
| 4,641,902 | 2/1987 | Fusselman | 439/607 |
| 4,874,336 | 10/1989 | Marsh | 439/607 |
| 5,147,220 | 9/1992 | Lybrand | 439/607 |
| 5,599,207 | 2/1997 | Lai | 439/607 |
| 5,603,639 | 2/1997 | Lai et al. | 439/607 |

*Primary Examiner*—J. J. Swann

*Attorney, Agent, or Firm*—Silverman, Cass & Singer, Ltd.

[57] ABSTRACT

An interface connector is disclosed which is inexpensive to manufacture and easy to assemble and able to maintain a sufficient strength of hooks when being engaged with a mating connector. An insulator of the connector covered with a shell includes flanges. Each of the flanges is provided with an engaging aperture having a size allowing a hook to be inserted thereinto in the surface of the flange on the fitting side with a mating connector and a further engaging aperture having a size allowing an earth plate to be inserted thereinto in the end surface of the flange. The two engaging apertures are connected each other in the flange. The hook is provided with anchoring portions engaging the earth plate. The earth plate is also provided on its inner end with engaging portions engaging the hook. The hook and the earth plate are connected to each other in the two engaging apertures.

7 Claims, 3 Drawing Sheets

INTERFACE CONNECTOR

BACKGROUND OF THE INVENTION

This invention relates to an interface connector for connection between electronic appliances and more particularly to a construction for firmly fixing hooks to a connector, the hooks being adapted to engage a mating connector.

FIG. 2 illustrates a hitherto used interface connector 50 in a perspective view. Such a known interface connector 50 is mainly composed of contacts 60, an insulator 56 and a shell 58. The plurality of contacts 60 are held and fixed in the insulator 56 as by press-fitting. The contacts 60 are made of a metal and formed as by the known press-working.

The insulator 56 is made of a resin and formed as by the known injection molding. The insulator 56 having a plurality of the contacts 60 held and fixed therein is covered by the shell 58 to obtain a shielding effect. The shell 58 is generally a die-cast product which is formed as by the publicly known die casting process.

Hooks 52 adapted to engage a mating connector are integrally formed with the shell 58 by the die casting process. Each of the hooks 52 is provided at the upper end with engaging portions 54 engaging the mating connector.

In recent years, such connectors have been strongly required to be more inexpensive as is usual with other parts. There is one method for reducing its production cost, in which a shell 58 is formed by the sheet metal working (referred to hereinafter "press-working") instead of die casting process. In press-working the shell 58 in place of the die casting process, however, it is difficult to form the hooks integrally with the shell if not impossible, so that the production cost remains the same.

In order to overcome this difficulty, an attempt has been made to form hooks as separate parts which are then attached into an insulator by press-fitting. However, the attachment between the insulator and the hooks will be so weak that the hooks tend to remove from the insulator after repetition of the connection to and disconnection from a mating connector.

SUMMARY OF THE INVENTION

It is an object of the invention to provide an interface connector which is inexpensive to manufacture and easy to assemble and able to maintain the sufficient strength of hooks after prolonged use.

In order to accomplish this object, in an interface connector including a plurality of contacts, an insulator for holding and fixing the contacts therein, a shell for covering said insulator, and hooks engaging a mating connector, according to the invention said insulator covered with said shell comprises flanges, each of said flanges being provided with an engaging aperture having a size allowing said one hook to be inserted thereinto in the surface of the flange on the fitting side with said mating connector and a further engaging aperture having a size allowing an earth plate to be inserted thereinto in the end surface of the flange, said two engaging apertures being connected to each other in said flange, said hook being provided with anchoring portions engaging said earth plate, said earth plate being provided on its inner end with engaging portions engaging said hook, thereby connecting said hook and said earth plate to each other in said two engaging apertures.

With this arrangement, the hooks and the earth plates can be readily inserted into the respective engaging apertures of the flanges so that the hooks and the earth plates are easily connected to each other in the connected engaging apertures. Moreover, the earth plates and the hooks are connected substantially perpendicular to each other (in this case, the term "substantially" means a range of ±5°).

The present invention has the following significant effects. The interface connector according to the invention can be easily assembled because of the easy insertion of the hooks and the earth plates into the engaging apertures of the flanges to ensure the easy connection between the hooks and the earth plates in the connected engaging apertures. The strength attaching the hooks to the insulator can be maintained even after repetition of the connection to and disconnection from a mating connector because the earth plates have wide surfaces in contact with the insulator and connected to the respective hooks substantially perpendicular to each other. The shell is formed by press-working instead of die casting process and the hooks are formed separately from the shell so as to facilitate the assembling of the connector to reduce its cost by about 20%.

The invention will be more fully understood by referring to the following detailed specification and claims taken in connection with the appended drawings.

DESCRIPTION OF THE PREFERRED EMBODIMENTS

Figure 1A:
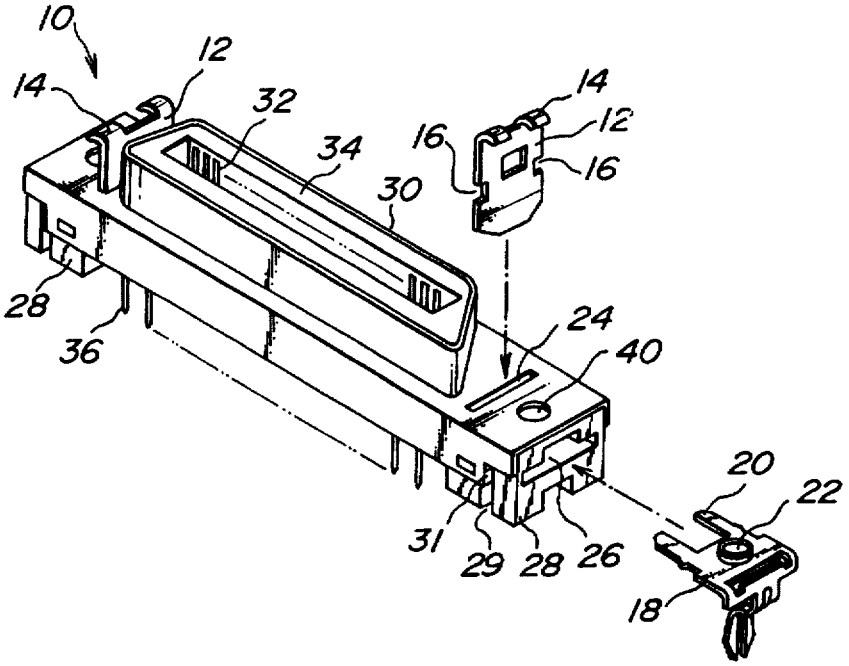
FIG. 1A is a perspective view illustrating an interface connector with hooks and earth plates (only one shown in the drawing) according to the invention.

One embodiment of the invention will be explained by referring to FIG. 1A hereinafter. FIG. 1A illustrates in a perspective view an interface connector 10 with hooks 12 and earth plates 18 (only one shown) according to the invention. The interface connector 10 according to the invention mainly comprises contacts 32, an insulator 34, a shell 30, hooks 12 and earth plates 18.

The dimension of the interface connector 10 with which the invention is concerned varies over a wide range. The connector according to the shown embodiment of the invention has a length of the order of 50 mm, a width of 10 mm and a height of 20 mm. The length of the connector varies depending upon the pitch of contacts and the number of cores. The connector in the shown embodiment has 50 (fifty) cores, and the contacts arranged with a pitch of 1.27 mm. The pitch of contacts may vary over a range of 0.5 mm to 2.54 mm and the number of cores may range from 1 to 120. These values may be suitably selected in design of the connector in accordance with its function or the like.

While the contact tails 36 of the contacts of the "straight dip type" have been used in the connector of the shown embodiment, contact tails of the "surface mounting type" (referred to hereinafter as the "SMT") or the "L-shaped dip type" may be likewise used.

A plurality of contacts 32 are formed as by the known press-working and held by and fixed to the insulator 34 in the same manner as in the prior art. Examples of materials for the contacts 32 are good electric conductive materials such as brass, phosphor bronze and beryllium copper as hitherto used. The phosphor bronze is the most preferable in consideration of springiness required for the contacts.

The insulator 34 is manufactured by the injection molding or the like in the same manner as in the prior art. Examples of materials for the insulator 34 are PBT, PET, PA, PPS, LCP and the like which have been used as in the prior art in view of the formability and cost. The PBT is the most preferable in consideration of cost.

The shell 30 covers the insulator 34 with a plurality of contacts 32 held and fixed therein to provide the shielding effect. The shell 30 is made of a metal and formed by the known press-working or the like. Examples of materials for the shell 30 are brass, steel, stainless steel and the like. The brass and steel are preferable in view of the workability and cost.

The shell 30 is fixed to the insulator 34 as by calking. In order to fix the shell 30 to the insulator 34, the shell 30 has lugs 31 which would be bent in grooves 29 formed at flanges 28 of the insulator 34. (See FIG. 1E)

One of the subject features of the present invention lies in the hooks 12. The hooks 12 are adapted to engage a mating connector (not shown) to hold the two connectors together.

Each of the hooks 12 is provided at the one end with engaging portions 14 bent in the form of a U-shape for engaging the mating connector. The engaging portions 14 may have any shape so long as they are able to engage the mating connector. Although the two engaging portions 14 of the hook 12 shown in FIG. 1A are divided by a notch therebetween, a single engaging portion 14 extending over the entire width of the hook 12 may be used.

The hook 12 is formed with anchoring portions 16 in the form of a rectangular notch at both its sides nearer to the other end for engaging the earth plates 18. In the shown embodiment, the anchoring portions 16 are at a distance of the order of 2 mm from the other end of the hook 12. The position of the anchoring portions 16 may be selected in design in accordance with the extending distance of the hook 12 from the flange 28, the size of the flange 28, the position of an engaging aperture 26 (later described), the strength of the hook 12, the strength of the flange 28 and the like.

The height of the rectangular anchoring portions or notches 16 is sufficient to be of the order of 0.05 to 0.1 mm more than the thickness of the earth plates 18. The width of the rectangular anchoring portions 16 is of the order of 1.0 mm in the shown embodiment, which may be suitably selected in design in consideration of the strength of the hooks.

The other end of the hook 12 is preferably chamfered or tapered off as shown in FIG. 1A in order to facilitate the insertion of the hook 12 into an engaging aperture 24 in the flange 28 of the interface connector 10. The hooks 12 in the shown embodiment have a width of the order of 7.3 mm, a height of 10 mm and a thickness of 2.3 mm. The hooks 12 are formed by the known press-working. The hooks 12 are made of a stainless steel in view of the strength. However, any metals may be used for this purpose so long as their strength and function satisfactorily fulfill the requirements for the hooks 12.

Another subject feature of the present invention lies in the earth plates which will be explained hereinafter.

Each of the earth plates 18 is provided at one end with engaging portions 20 adapted to engage the anchoring portions 16 of the hook 12. The engagement of the engaging portions 20 with the anchoring portions 16 of the hooks 12 prevents the dislodgment of hooks 12 from the interface connector 10. The tip ends of the engaging portions 20 are preferably chamfered or tapered off as shown in FIG. 1A in order to facilitate the insertion of the engaging portions 20 into an engaging aperture 26 in the flange 28 of the interface connector 10.

The earth plate 18 is formed at the center with an aperture 22 whose diameter is slightly larger than that of set-screws for securing the connector 10 to a panel or the like. The aperture 22 is aligned with an aperture 40 of the flange 28 when the hook 12 has been engaged with the earth plate 18. In the embodiment shown in FIG. 1A, the earth plate 18 includes lock pins formed integrally therewith and depending downward (as viewed in FIG. 1A) from its other end for temporarily attaching the connector to a printed-circuit board or the like.

Figure 1B:
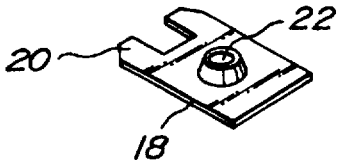
FIGS. 1B, 1C and 1D are perspective views illustrating modifications of the earth plate used in the interface connector according to the invention, respectively.
Figure 1C:
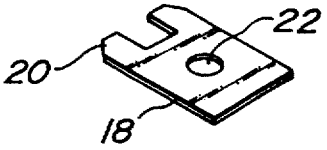

FIGS. 1B and 1C perspectively illustrate modifications of the earth plate 18, respectively. The earth plate 18 shown in FIG. 1B includes an internal threaded portion corresponding to the aperture 22. The earth plate 18 shown in FIG. 1C does not have lock pins which shown in FIG. 1A.

The earth plate 18 in the shown embodiment has a length of the order of 8.3 mm, a width of 7.2 mm and a thickness of 0.5 mm. Examples of materials for the earth plates 18 are generally brass, phosphor bronze, beryllium copper and the like, the brass being preferable in consideration of the cost and workability. The earth plates 18 made of a metal are formed by the known press-working.

Figure 1D:
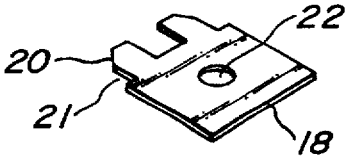
Figure 1E:
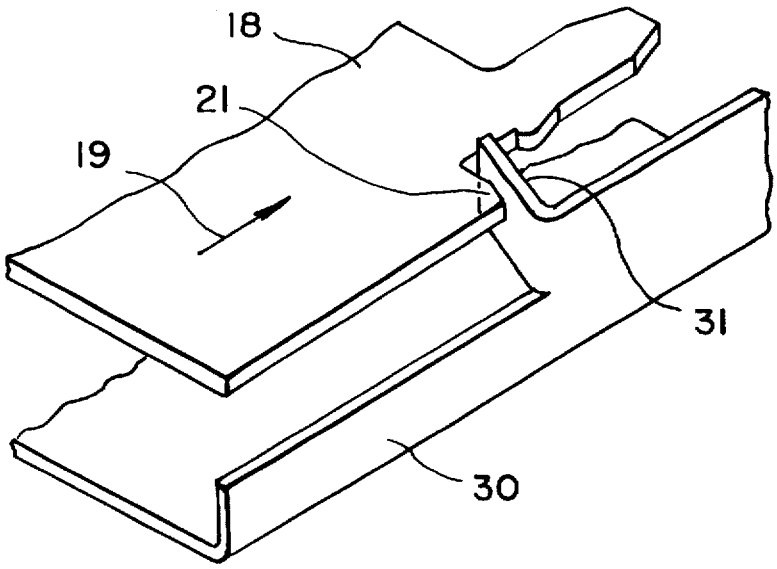
FIG. 1E is an enlarged partial perspective view showing the earth plate and the shell in contact with each other, with the insulator removed; and, FIG. 2 is a perspective view illustrating an interface connector of the prior art.
Figure 2:
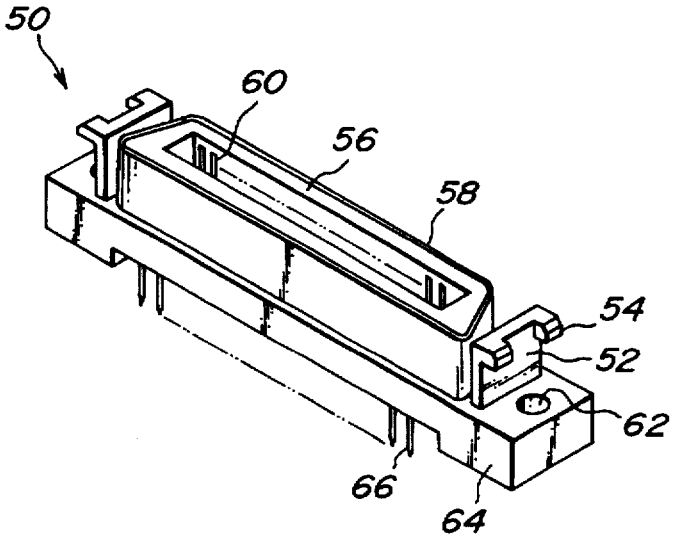
FIG 2 PRIOR ART

In the modification shown in FIG. 1D, the earth plate 18 is provided with shoulders or notches 21 on the sides of the engaging portions 20 engaging the hook 12. When the earth plate 18 is inserted into the flange 28, (the direction of insertion shown by arrow 19 in FIG. 1E), one of the notches 21 is brought into contact with one of the lugs 31 of the shell 30 to establish the continuity between the shell 30 and the earth plate 18, thereby improving the shielding performance of the connector. The notches 21 may have any shape so long as it allows the notches 21 to contact the lugs 31. The notches 21 may be dispensed with as the case may be, as shown in FIGS. 1A to 1C.

The size of the notches 21 may be suitably determined in design in consideration of the strength of the earth plates 18. In the shown embodiment, the notches 21 have a length of 4 mm and a width of the order of 0.7 mm to 1 mm. The size of the lugs 31 of the shell 30 may be suitably selected in design so that the tip ends of the lugs 31 bent in the grooves 29 formed in the flanges 28 of the insulator 34 extend into the engaging apertures 26 of the flanges 28. The lugs 31 in the shown embodiment are of the order of 1.5 mm×1.8 mm.

A further subject feature of the present invention lies in the flanges 28 of the interface connector 10, into which the hooks 12 and the earth plates 18 are inserted. The flanges 28 will be explained hereinafter.

Engaging apertures 24 into which the hooks 12 are inserted are formed in the flanges 28 on which side a mating connector is fitted. The location of the engaging apertures 24 may be suitably selected in design in accordance with the positions of parts of the mating connector to be engaged with the connector 10.

The engaging apertures 24 have no limitation as regards their size so long as the hooks 12 can be inserted into the engaging apertures 24. However, the engaging apertures 24 which are 0.05 mm to 0.1 mm larger than the hooks 12 are preferable and sufficient in view of the positional accuracy, engaging strength and the like. The insulator 34 is formed at both the ends with engaging apertures 26 into which the earth plates are inserted, respectively.

The location of the engaging apertures 26 may be suitably selected in design in accordance with the positions of the anchoring portions 16 of the hooks 12 and the strength of the flanges 28. The engaging apertures 26 have no limitation as regards their size so long as the earth plates 18 can be inserted into the engaging apertures 26. However, the engaging apertures 26 which are 0.05 mm to 0.1 mm larger than the earth plates 18 are preferable and sufficient in view of their positional accuracy, engaging strength therebetween, the strength of the flanges 28 and the like.

Through-apertures 40 are formed in the flanges 28, on which side a mating connector is fitted, for attaching the connector 10 to a panel or printed-circuit board. The position of the through-apertures 40 may be suitably determined in design in accordance with the positional relation to the hooks 12 and the positional relation to the panel or printed-circuit board.

Each of the flanges 28 is formed on one side edge with a groove 29 communicating with the engaging aperture 26. The bent portion of the lug 31 is received in this groove 29. The groove 29 has no limitation as regards its size, so long as the groove 29 provides a space making it possible to bend the lug 31. The size of the groove 29 may be suitably determined in design in view of the strength of the flange 28. The groove 29 in the shown embodiment has a width of 1.5 mm and a height of the order of 0.6 mm.

The method for assembling the hook 12 and the earth plate 18 in the interface connector 10 will be explained hereinafter.

The hook 12 is inserted into the engaging aperture 24 formed in the flange 28 of the interface connector 10 in the direction shown by an arrow A in FIG. 1A. In this case, the hook 12 is so positioned that the anchoring portions 16 of the hook 12 are aligned with the engaging aperture 26 provided in the flange 28.

The earth plate 18 is then inserted in the direction shown by an arrow B in FIG. 1A into the engaging aperture 26 of the flange 28 having the hook 12 inserted therein. At this time, the engaging portions 20 of the earth plate 18 engage the anchoring portions 16 of the hook 12 in the engaging apertures 24 and 26. With the engagement of the hook 12 with the earth plate 18, the aperture 40 of the flange 28 is aligned with the aperture 22 of the earth plate 18. In this manner, the hook 12 and the earth plate 18 are assembled in the interface connector 10, manually or automatically.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An interface connector including a plurality of contacts, said connector comprising, an insulator for holding and fixing the contacts therein, a shell for covering said insulator, and hooks for engaging a mating connector, said insulator having flanges when it is covered with said shell, each of said flanges being provided with an engaging aperture having a size allowing one hook to be inserted thereinto in a surface of the flange on a mating side with said mating connector and a further engaging aperture having a size allowing an earth plate to be inserted thereinto in an end surface of the flange, said two engaging apertures being connected to each other in said flange, said hook being provided with anchoring portions engaging said earth plate, said earth plate being provided on an inner end with engaging portions engaging said hook, thereby connecting said hook and said earth plate to each other in said two engaging apertures, each of said flanges of the insulator covered with said shell being provided in one side surface with a groove communicating with said further engaging aperture of the flange, said earth plate being provided with a notch on one side of said engaging portions engaging said hook, said shell being provided with lugs, each of said lugs being bent into said groove so that a tip end of the bent lug extends into said further engaging aperture of the flange to contact said notch of the earth plate.

2. The interface connector as set forth in claim 1, wherein said earth plate and said hook are connected at an angle substantially at right angles.

3. The interface connector as set forth in claim 1, wherein said hook has an engaging portion having a shape engaging the mating connector with the overall width of said engaging portion.

4. The interface connector as set forth in claim 1, wherein the end of said hook to be inserted into the flange is chamfered to facilitate the insertion.

5. The interface connector as set forth in claim 1, wherein the end of said earth plate to be inserted into the flange is chamfered to facilitate the insertion.

6. The interface connector as set forth in claim 1, wherein said earth plate is provided near at the center with means for connecting the interface connector to a panel.

7. The interface connector as set forth in claim 1, wherein said earth plate is integrally formed at the end opposite to its engaging portions with at least one lock pin to be connected to a printed-circuit board.

* * * * *